US006910363B2

(12) United States Patent
Beetz et al.

(10) Patent No.: US 6,910,363 B2
(45) Date of Patent: Jun. 28, 2005

(54) PLIERS HEAD FOR PRESSING WORK PIECES

(75) Inventors: Horst Beetz, Stadtallendorf (DE); Kurt Battenfeld, Ebsdorfergrund-Wittelsberg (DE)

(73) Assignee: WEZAG GmbH Werkzeugfabrik, Stadtallendorf (DE)

( * ) Notice: Subject to any disclaimer, the term of this patent is extended or adjusted under 35 U.S.C. 154(b) by 106 days.

(21) Appl. No.: 10/659,619

(22) Filed: Sep. 10, 2003

(65) Prior Publication Data

US 2004/0055357 A1 Mar. 25, 2004

(30) Foreign Application Priority Data

Sep. 12, 2002 (DE) ..... 102 42 345

(51) Int. Cl.[7] ..... B21D 7/06

(52) U.S. Cl. ..... 72/409.14; 72/409.01; 72/456; 29/751; 81/129

(58) Field of Search ..... 72/409.01, 409.14, 72/409.19, 456; 29/751, 270; 81/129

(56) References Cited

U.S. PATENT DOCUMENTS 3,903,725 A * 9/1975 Rommel ..... 72/409.09
5,077,998 A * 1/1992 Santorio ..... 72/17.2
5,105,648 A * 4/1992 Steiner et al. ..... 72/409.08
6,026,671 A 2/2000 Battenfeld ..... 72/409.12

FOREIGN PATENT DOCUMENTS

DE 19807737 A1 9/1999

* cited by examiner

*Primary Examiner*—Daniel C. Crane
(74) *Attorney, Agent, or Firm*—Thomas, Kayden, Horstemeyer & Risley, LLP

(57) ABSTRACT

A pliers head (1) for pressing work pieces includes a stationary die (20) and a movable die (19). A first element (15) is designed as a comparatively stiff housing (5). A second element (16) is designed as a lever (7). The lever (7) is subjected to a pretensional force (36). The pretensional force (36) has at least the value of a predetermined maximum pressing force of the pliers head (1). The first and second element (15, 16) are designed as separate parts, and they form a C-shaped mouth (14). The dies (19, 20) are located in the C-shaped mouth (14). A joint (10) is located at the first element (15), and it allows for pivotal movement of the second element (16) with respect to the first element (15). A stop (32) secures a parallel position of the stationary die and the movable die with respect to one another. As a result, the resulting pretensional torque counteracts the pressing torque, and the parallel arrangement of the dies (19, 20) is maintained.

25 Claims, 6 Drawing Sheets

PLIERS HEAD FOR PRESSING WORK PIECES

CROSS REFERENCE TO RELATED APPLICATIONS

This application claims priority to co-pending German Patent Application No. 102 42 345.8 entitled "Zangenkopf zum Verpressen eines Werkstücks", filed Sep. 12, 2002.

FIELD OF THE INVENTION

The present invention generally relates to a pliers head for pressing work pieces. More particularly, the pliers head may serve to produce solderless crimping connections. However, it may also be used to simply deform work pieces. The pliers head may be part of pliers which are driven by hand, meaning which include two handles to be pivoted with respect to one another by the hand of the user. The pliers head may also be used in combination with an electric tool, a pneumatic tool or a hydraulic tool for driving the dies being located in the pliers head to conduct a pressing operation.

BACKGROUND OF THE INVENTION

Hand operable pliers including a pliers head are known from German Patent Application No. 198 07 737 A1 corresponding to U.S. Pat. No. 6,026,671. The known pliers head includes two cover plates having the shape of a "C" to form a C-shaped mouth or opening. The C-shape is required to insert work pieces from one side, or to be capable of using the pliers head at work pieces which are continuous in a direction perpendicular with respect to the plane of main extension of the pliers head. In the known pliers head, two dies are arranged in the region of the C-shaped mouth. The dies are designed and arranged to be replaceable. The first die is designed as a stationary die, and the second die is designed to be movable by a drive. The movable die is linearly guided in straight channels being located in the cover plates. A toggle lever drive serves to linearly drive the movable die. With the known pliers including a pliers head, it is desired to achieve improved tilting resistance of the movable die. This result is achieved by the guiding protrusions being located at the C-shaped mouth have a great basis for the linearly movable die. In this way, reproducible precision of the pressing quality and tilt resistance of the linear guidance of the movable die are improved such that the crimping quality is increased.

In addition to the improvement concerning the linear guidance of the movable crimping die, it is also known from German Patent Application No. 198 07 737 A1 and U.S. Pat. No. 6,026,671 that pliers heads having a C-shaped mouth generally have the drawback of the correspondingly C-shaped cover plates showing resilient effects when great pressing forces are applied. Despite the linear guidance of the movable pressing die, the two pressing dies reach an angled position which not only has a negative influence on the pressing quality, but which also leads to early wear and tear of the pressing dies. Due to the resilient effects of the cover plates within a certain but limited angle, undesired pressing marks may occur in the nests of the dies. These pressing marks result in undesired changes of the nests. Consequently, in the case of a C-shaped design of the pliers head, it is preferred to counteract resilient effects of the pliers head especially during great pressing forces by the arrangement of additional stiffening plates. The stiffening plates may be added to the covering plates to increase stiffness of the C-shaped mouth and to counteract resilient effects. Especially in the case of hand driven tools such as hand operable pliers, the possibilities of increasing the mass in the region of the C-shaped opening and of designing a C-shaped mouth as a stiff and non-resilient body are limited. In many cases, it is not possible to arrange stiffening plates in the pliers head since adjusting units and the like for determining the pressing position of the work piece are located in this region.

In addition to the arrangement of stiffening plates, German Patent Application No. 198 07 737 A1 and U.S. Pat. No. 6,026,671 also teach to associate a pivoting element with the C-shaped mouth. The pivoting element serves to close the opening of the C-shaped mouth. In this way, resilient effects of the C-shaped mouth are counteracted.

SUMMARY OF THE INVENTION

The present invention relates to a pliers head including a stationary die and a movable die. A first element is designed as a comparatively stiff housing. A second element is designed as a lever. The lever is designed and arranged to be subjectable to a pretensional force. The pretensional force has at least the value of a predetermined maximum pressing force of the pliers head. The first and second element are designed as separate parts, and they are designed and arranged to form a C-shaped mouth. The dies are located in the C-shaped mouth. A joint is located at the first element, and it is designed and arranged to allow for pivotal movement of the second element with respect to the first element. A stop is designed and arranged to secure a parallel position of the stationary die and the movable die with respect to one another.

The present invention also relates to a pliers head for pressing work pieces including a stationary die and a movable die. The stationary die and the movable die are associated with one another to form at least one nest being designed and arranged for receiving a work piece to be pressed. The pliers head also includes a housing. The housing is designed to be comparatively stiff. The housing is designed and arranged to support the movable die in a way that the movable die is movable in a linear direction towards and away from the stationary die. A lever is connected to the stationary die. The lever and the housing are designed as separate parts, and they are designed and arranged to form a C-shaped mouth in which the dies are located. A joint is designed and arranged to connect the housing and the lever in a way that the lever may be pivoted with respect to the housing about the joint. A stop is designed and arranged to limit pivotal movement of the lever with respect to the housing. A resilient element is designed and arranged to supply pretensional torque to the lever. The pretensional torque counteracts pressing torque resulting from a movement of the movable die towards the stationary die. In this way, the resilient element and the stop are designed and arranged to secure a parallel position of the first and second die with respect to one another.

The present invention is based on the concept of designing the C-shaped mouth of the pliers head to include two separate elements of which one is connected to the first die and the other is connected to the second die. The dies are located at the legs of the C-shaped mouth to be replaceable. The first element is designed as a housing being comparatively stiff to bending. The second element is supported at the first element by a joint to be pivoted about the axis of the joint. In this way, the second element with its die may be moved with respect to the first element about the joint. This movement is limited by a stop. The stop ensures the parallel position of the dies during the pressing or crimping operation.

For this purpose, the pivotable second element is designed as a lever which may be subjected to pretension. The lever may be subjected to tension the value of which approximately corresponds to the value of the maximum pressing force. When the pretensional force is slightly less than the maximum pressing force, there will still be a small part at the end of the pressing stroke at which there are small resilient effects. The lever is put under pretension against the securing stop. The pressing force counteracts the pretensional force during the pressing operation such that the pretensional force is "consumed" when the pressing operation continues. The lever does not move. Due to these effects, the parallel position of the dies may be maintained during the entire pressing operation, and undesired resilient effects of the C-shaped opening of the pliers head are effectively prevented.

The present invention takes into account the fact that it will only be possible to design components to be stiff to bending to a limited extent. In other words, no component is absolutely stiff, but there are components which are comparatively stiff and such ones which are comparatively resilient. The novel pliers head counteracts resilient effects of its components with respect to one another by applying a pretensional force. Preferably, the pretensional force is chosen to be adjustable to allow for adjustment of the pliers to different sizes of work pieces. However, it is also possible to chose the pretensional force such that the usual range of sizes of work pieces is covered thereby.

The pretensional force being supplied to the lever produces pretensional torque about the axis of the joint of the lever in one sense of rotation such that a reaction force builds up at the stop which secures the parallel position of the dies. The reaction force produces reaction torque being directed in the opposite sense of rotation about the joint. The reaction torque has the same value as the pretensional torque. The reaction torque is taken over during the pressing operation by torque being produced by the pressing force acting upon the lever. In this way, the stop will be increasingly freed from subjection to forces during the pressing operation. It is ensured that the pretensioned lever maintains its parallel position, and thus the parallel position between the dies is maintained during the entire pressing operation.

The lever may at least be partly designed as a deformable bending lever including a first lever arm and a second lever arm. The first lever arm is designed to be comparatively stiff to bending. The first lever arm is connected to the stationary crimping die. The second lever arm is designed to be comparatively resilient. The second lever arm is not connected to the dies. In this way, the lever also fulfills the resilient spring function which is required for supplying the pretensional force. It is to be understood that each technical element cannot be designed to be absolutely stiff and stiff to bending. Every technical element always has more or less resilient properties. It is preferred if the lever arm which is not connected to a die fulfills the function of a spring due to its comparatively thin and weak design. However, it is also possible to design the entire lever to be subjected to pretension to be preferably stiff to bending and to provide the spring function by a separate element, especially by a disc spring or a package of disc springs. The lever arm carrying the die preferably is designed to be stiff to bending. This means that this lever arm is capable of accepting different pretensional forces without resulting in substantial movement of the lever arm.

The joint may include a pin being connected to the stiff housing. The lever may be designed as a rocking lever having a middle portion. The rocking lever with its middle portion is designed and arranged to be pivotable about the pin. Such a rocking lever is to be understood as a lever which is pivotally supported in its middle portion and of which the two lever arms extend in different directions as seen from the axis of the joint and of the pin, respectively. It is to be understood that the first element of the C-shaped opening is designed to be preferably stiff and stiff to bending. In other words, the first element is designed as a stiff housing at which action forces and reaction forces may be supported without resulting in substantial bending of the stiff housing.

There is the possibility of designing the lever to have an approximately perpendicular shape such that the two lever arms of the lever are arranged at an approximately right angle with respect to one another. In such a design, it is advantageous to design the lever arm which does not carry a die to be comparatively long, and to place it in the direction of main extension of the pliers and of the pliers head, respectively. When the stiff housing has a design including plates—meaning at least two cover plates—there is the possibility of also designing the lever to include plates being located between these cover plates in a safe and space-saving manner. The other lever arm which does carry a die may then be located within the pliers head in a transverse direction with respect to the direction of main extension of the pliers such that one attains an opening or a mouth which is similar to the known shape of such pliers and pliers heads, respectively. However, the novel pliers head does not require more space than known pliers heads. It is also possible to arrange the two lever arms at an angle of approximately 180°.

In an especially simple embodiment of the novel pliers head, the stop serving to secure the parallel position of the dies is designed as a pin or a bolt. The pin protrudes through the stiff housing and the lever. For this purpose, there are respective bores or openings being located in the elements. The pin may also protrude through the housing or the lever in an elongated hole, the elongated hole exclusively being located in one of the two elements. The stop has to be effective in one direction to secure the parallel position of the dies with respect to one another. In the other sense of rotation, there may be the possibility of the stop allowing for certain resilient effects in a pressing region. The elongated hole may fulfill a safety function in this way, especially in the case when a work piece which is too big is pressed by mistake, for example. Such a work piece cannot be used thereafter, but however such an operating error does not lead to the components of the novel pliers head being damaged.

An eccentric bolt being supported at the stiff housing may serve as the adjustable stop for supplying the pretensional force. In this way, the novel pliers head uses an element known from prior art crimping pliers for a different purpose.

When the pliers head is designed to include a plurality of plates, it is preferred to design the stiff housing to include two cover plates and to design the lever to include two plates which are arranged to be symmetric with respect to the plane of main extension of the pliers head. This arrangement is especially preferred to attain optimum support of the replaceable dies in the pliers head.

Generally, one may freely chose to which one of the two elements the stationary die is connected and to which one the movable die is connected. However, it is preferred to design and arrange the lever to carry the stationary die, and to guide the movable die at the stiff housing. It is possible to chose an especially long guiding path of the movable die.

As an alternative to the use of a bending lever, the entire lever of the novel pliers head may be designed to be stiff to bending. For still attaining the desired resilient spring effect for applying pretension and for preventing non-parallel arrangement of the dies, the novel pliers head then includes a spring unit for supplying pretension to the lever. This spring unit may include one disc spring, a plurality of disc springs or other suitable spring elements. Preferably, these spring elements are chosen such that they are capable of accepting great forces at a comparatively small spring excursion.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
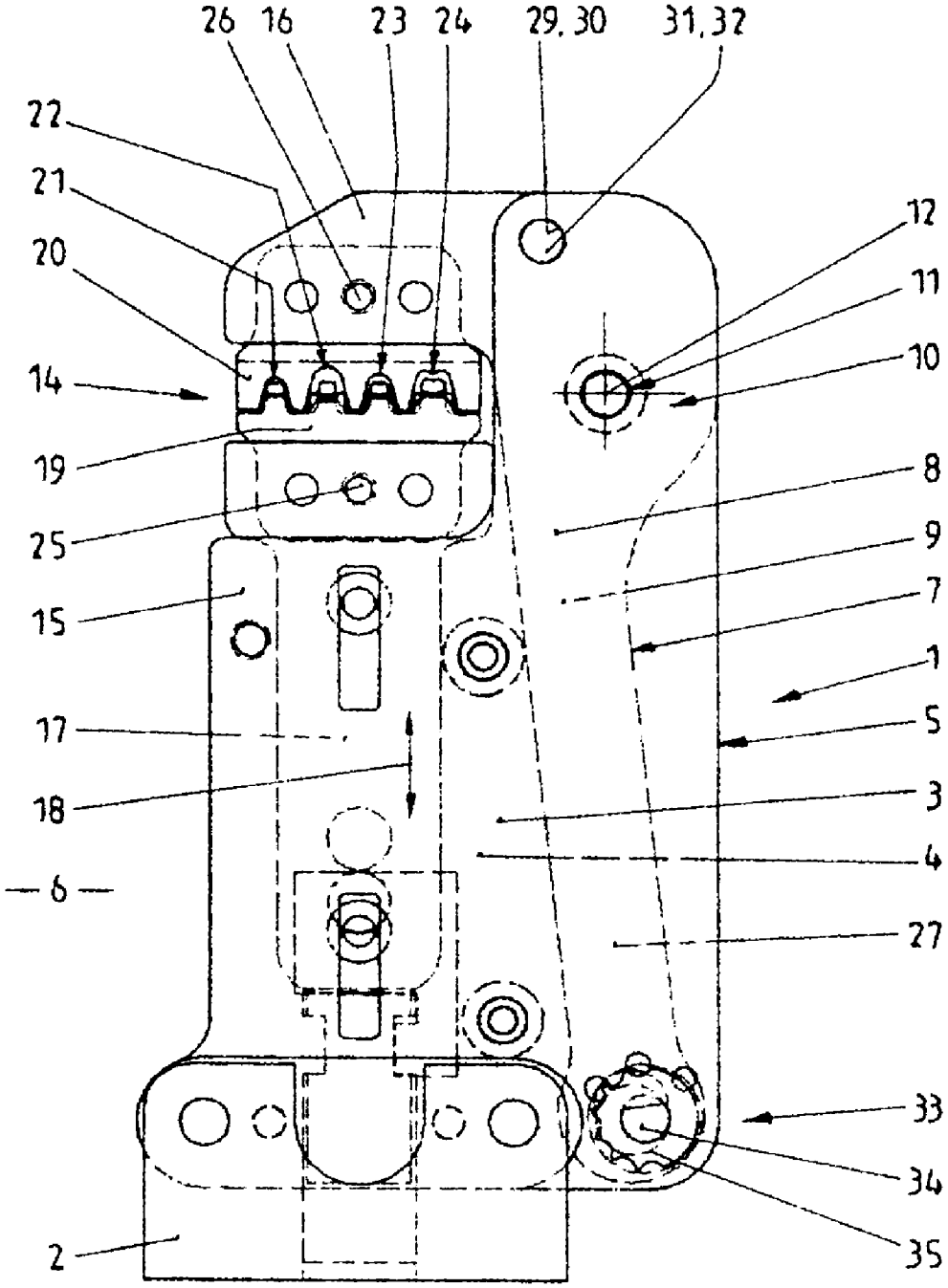
FIG. 1 is a top view of a first exemplary embodiment of the novel pliers head.

Referring now in greater detail to the drawings, FIG. 1 illustrates a novel pliers head 1. For example, the pliers head 1 may be connected to an electrically driven tool or an otherwise driven tool. For this purpose, the pliers head 1 includes a connecting element 2. The design and arrangement of the connecting element 2 is of no special importance to the present invention. Consequently, the connecting element 2 and the drive to be connected to the pliers head 1 by the connecting element 2 to form pliers are not explained in great detail. The design of the drive for the novel pliers head 1 may be conventional as known from the prior art.

Figure 2:
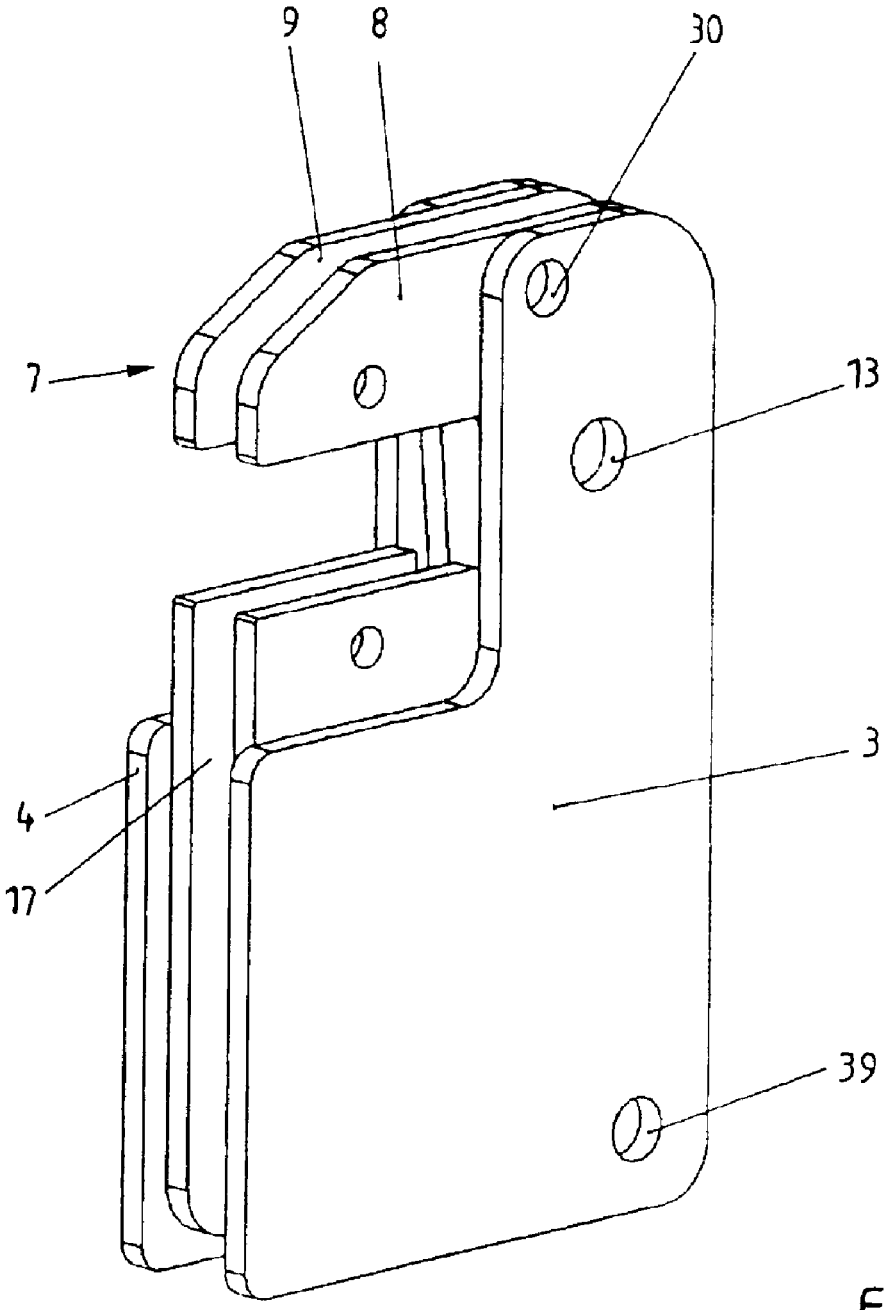
FIG. 2 is a perspective view of some of the elements of the novel pliers head as they may be especially used in combination with a hand tool.

Two cover plates 3 and 4 are fixedly connected to the connecting element 2. The cover plates 3 and 4 together form a stiff housing 5. The design and arrangement of these cover plates 3 and 4 is chosen to result in a preferably stiff unit which is comparatively resistant to bending. The two cover plates 3 and 4 are arranged to be symmetric with respect to a plane of main extension 6 (also forming the plane of illustration of FIG. 1) in a spaced apart manner. A lever 7 is arranged between the cover plates 3 and 4. The lever 7 is formed by two plates 8 and 9. The two plates 8 and 9 are also designed and arranged to be symmetric with respect to the plane of main extension 6 such that one attains a very compact pliers head 1. With respect to the three-dimensional arrangement of the elements, it is referred to the illustration of FIG. 2.

The two plates 8 and 9 together forming the lever 7 are supported to be commonly pivoted or rotated about a joint 10. The joint 10 includes a bolt 11 having an axis 12. The lever 7 is rotated about the axis 12 and within a plane parallel to the plane of main extension 6. The bolt 11 protrudes through openings 13 being located in the cover plates 3 and 4 and through respective openings being located in the plates 8 and 9.

The pliers head 1 at its top side facing away from the connecting element 2 and the drive to be connected to the connecting element 2 includes a C-shaped mouth 14. The mouth 14 is designed to be opened at one of its sides such that work pieces to be pressed or crimped may be inserted into the mouth 14 from this opened side. The mouth 14 is formed by a first element 15 and a second element 16. The first element 15 is formed by the stiff housing 5 and by the two cover plates 3 and 4, respectively. The second element 16 is formed by the lever 7. A guiding bar 17 is located in the mouth 14 and in the first element 15 and between the two cover plates 3 and 4, respectively. The guiding bar 17 is designed and arranged to be moved in a linear way by a drive (not illustrated) in the direction of double arrow 18 with respect to the housing 5. A movable die 19 is located at the upper end of the guiding bar 17. The movable die 19 is designed and arranged to be replaceable. A stationary die 20 is located at the lever 7 and at the second element 16, respectively. The stationary die 20 is also designed and arranged to be replaceable. In the illustrated exemplary embodiment of FIG. 1, the two dies 19 and 20 include four nests 21, 22, 23, 24 which may be alternately used for pressing different sizes and/or shapes of work pieces. It is to be understood that the number of nests may differ. Preferably, the number of nests is in a range of between 2 and 8. Socket pins 25 and 26 serve for realizing the replaceable connection of the dies 19 and 20. The socket pins 25 and 26 extend through openings being located in the guiding bar 17 and in the second element 16, respectively, to protrude through the lever 7.

Figure 4:
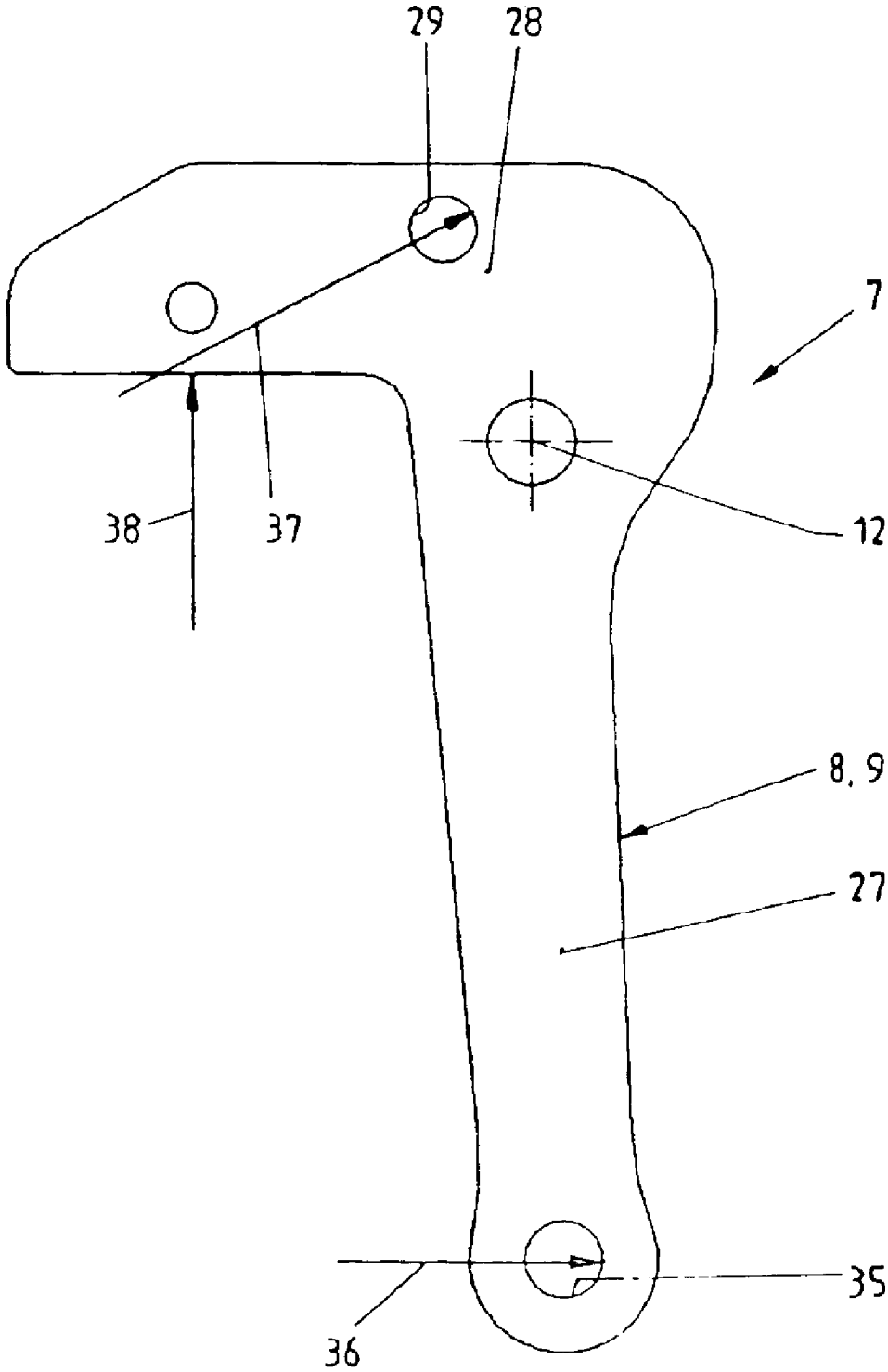
FIG. 4 is a top view of the bending lever of the pliers head according to FIGS. 1 to 3.

FIG. 4 clearly illustrates the shape and design of the lever 7. In this case, the lever 7 is designed as a rocking lever. In its middle portion, it is connected to the joint 10 having the axis 12. The lever 7 includes a first lever arm 27 and a second lever arm 28. In the illustrated exemplary embodiment, the lever arm 27 is designed to be longer than the lever arm 28. The lever arm 27 extends in the direction of main extension of the pliers head 1 which coincides with the direction according to double arrow 18 (the vertical direction in FIG. 1). Although the lever am 27 is comparatively long, it still fits in the stiff housing 5 between the cover plates 3 and 4. The shorter lever arm 28 extends in a transverse direction such that the two lever arms 27 and 28 are designed and arranged to be approximately perpendicular with respect to one another.

The lever arm 27 is designed and arranged as an elastic lever. This means that it is resilient and it fulfills resilient functions, respectively, to a certain extent. The lever arm 28 is designed to be comparatively stiff to bending. However, the terms "resilient" and "stiff" are to be understood in a broad and relative sense. However, when one of the lever arms is designated as being "comparatively stiff" and the other arm is designated as being "comparatively resilient", it is to be understood that the "comparatively stiff" lever arm is at least more stiff than the "comparatively resilient" lever arm.

The lever arm 28 includes an opening 29. To be exact, aligned openings 29 are located in the two plates 8 and 9. In the same way, the two cover plates 3 and 4 include respective openings 30. A pin 31 extends through the openings 29 and 30. The pin 31 is designed and arranged to form a stop 32. The stop 32 is designed and arranged to prevent common rotational movement of the lever 7 and of the two plates 8 and 9, respectively, about the axis 12. The openings 29 and 30 are arranged with respect to one another in a way that the inserted pin 31 secures the parallel position of the dies 19 and 20.

Figure 3:
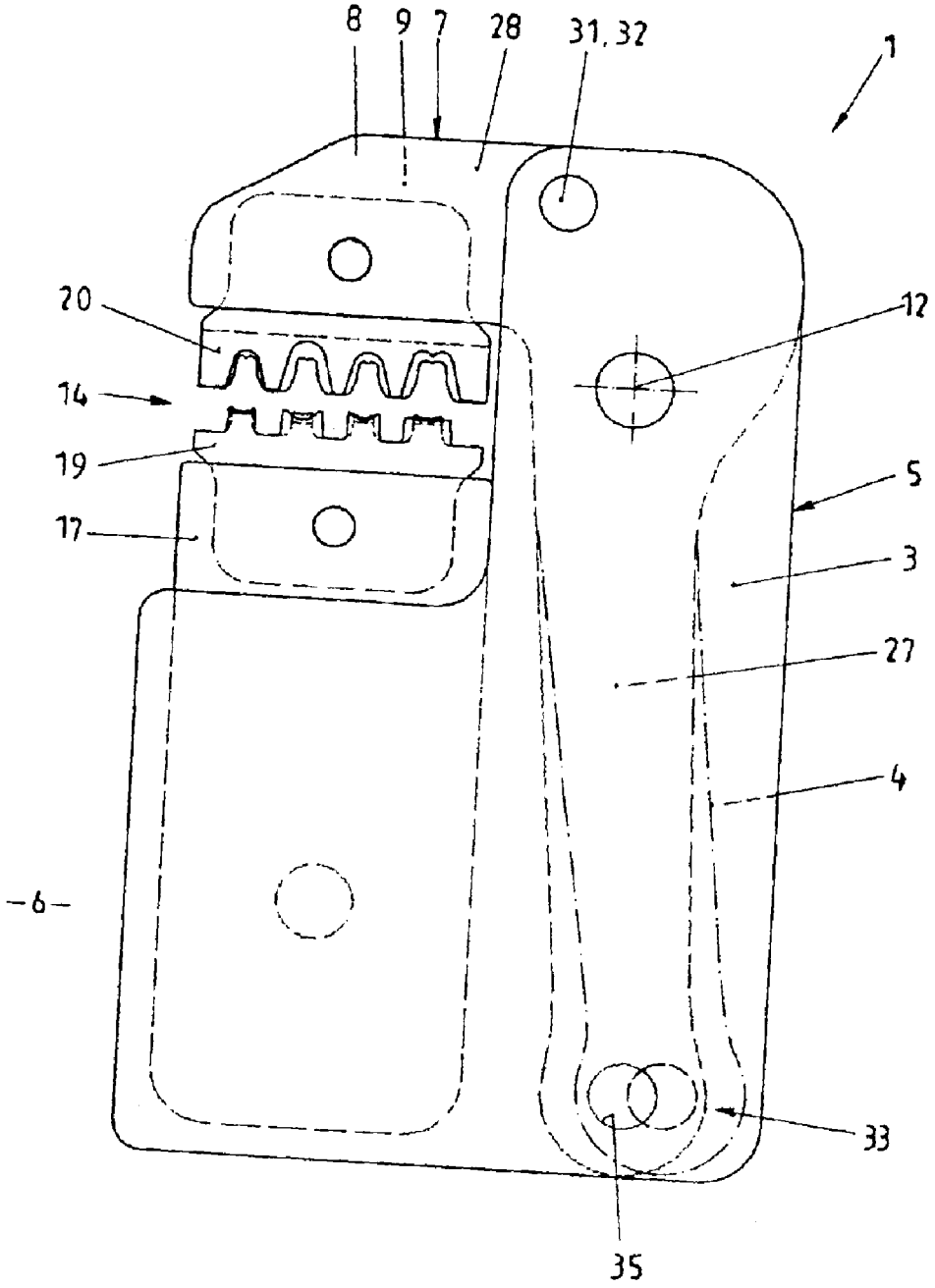
FIG. 3 is a top view of the pliers head according to FIG. 2 and illustrating the dies.

Another stop 33 is associated with the first lever arm 27 and the two plates 8 and 9, respectively. An eccentric pin 34 is part of the stop 36. The eccentric pin 34 engages a bore 35 being located in each of the two plates 8 and 9, and it cooperates with these bores 35, respectively. Such eccentric pins are generally known in the art, and it is therefore not necessary to explain them in greater detail. The bores 35 change their relative position about the axis 12 when rotating the eccentric pin 34, as this is illustrated in FIG. 3 by a dash-dot line. Due to this movement along a path, the lever 7 may be pretensioned. This results in elastic deformation of the lever arm 27 at the two plates 8 and 9. The pretensional force 36 supplied by the eccentric pin 34 is indicated by arrows in FIG. 4. The pretensional force 36 supplies counter-clockwise torque about the axis 12. The torque is the product of the value of the pretensional force 36 and the distance to the axis 12. The pretensional force 36 produces a reaction force 37. The stop 32 with the reaction force 37 prevents rotation of the lever 7 initiated by the pretensional force 36. It is to be seen from FIG. 4 that the reaction force 37 causes clockwise torque corresponding to the value of the reaction force 37 multiplied with the distance to the axis 12.

During a pressing operation with the pliers head 1, there is a pressing force 38 with which the work piece increasingly subjects the lever arm 28 during the continuing pressing operation. The pressing force 38 also produces torque about the axis 12, the torque being the product of the value of the pressing force 38 and the distance to the axis 12. During continuing pressing operation, the pressing force 38 increases to reach a maximum desired pressing force. The pressing force 38 increasingly replaces the reaction force 37. The pretensional force 36 is chosen such that the supplied pretensional torque at least equals or even exceeds the torque supplied by the pressing force 38 and the sum of the torques of the reaction force 37 and the pressing force 38, respectively. In this way, it is ensured that the lever 7 is not moved during the entire pressing operation, meaning along the entire pressing stroke. The lever arm 28 only serves to reduce pretension. The lever arm 28 is not moved such that it is ensured that the dies 19, 20 will always be parallel along the entire pressing stroke. In this way, resilient effects acting upon the C-shaped mouth 14 of the pliers head 1 are prevented during the pressing stroke. The eccentric pin 34 is rotatably supported in openings 39 being located in the cover plates 3 and 4.

FIG. 3 illustrates an intermediate position (see the continuous line) of the pliers head 1 during a stroke of the movable die 19 without an inserted work piece. The released lever 7 is indicated by the dashed line. The dash-dot line shows the lever 7 in the pretensioned position, meaning when the lever arm 27 is resiliently deformed. FIG. 1 illustrates a relative position of the dies 19 and 20 just before the dies 19 and 20 are closed, meaning towards the end of the pressing stroke.

Figure 5:
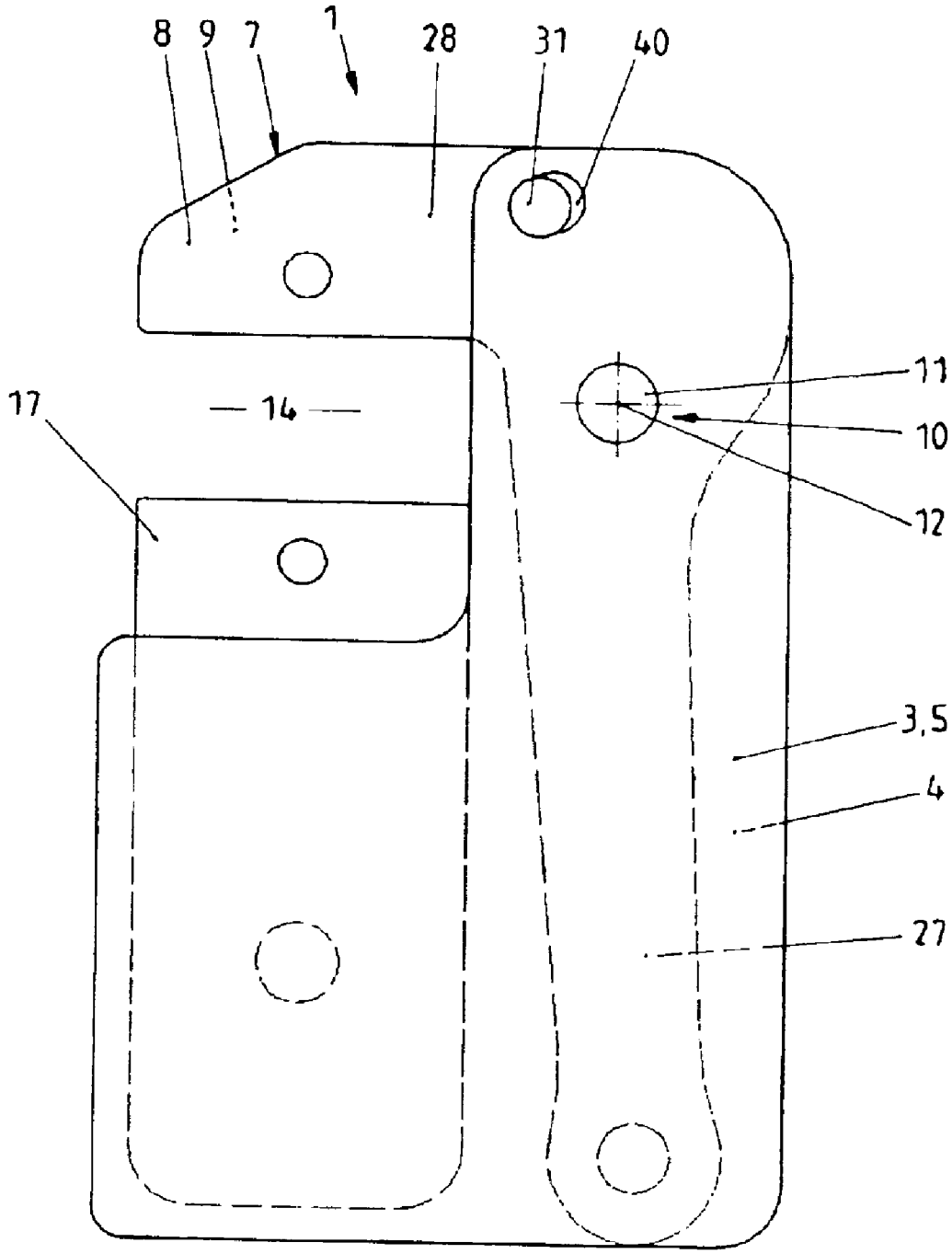
FIG. 5 is a view illustrating the arrangement of the novel pliers head in the region of the C-shaped mouth.

FIG. 5 illustrates another special feature of the novel pliers head 1. The pin 31 is fixedly arranged in circular bores being located in the two plates 8 and 9 forming the lever 7, and it protrudes through elongated holes 40 being located in the cover plates 3 and 4, meaning in the stiff housing 5. The design and arrangement of the elongated holes 40 is chosen such that they are located on a circular arc about the axis 12. A similar possibility of movement as a safety function may also be attained by a respective clearance. The clearance may also be provided between the pin 31 and the plates 8 and 9 taking into account the sense of rotation. The safety function protects the pliers head 1 from being damaged, for example, when a work piece is introduced into a nest which is too small for the size of the work piece, and the crimping operation is started, especially in combination with a locking unit which may only be released after having reached the end position. This arrangement is especially of importance in combination with pliers which are driven by hand, meaning pliers which have usual handles to be grasped by the hands of the user. However, the safety function of allowing for resilient effects of the C-shaped opening 14 when there is too much stress may also make sense in combination with an electric, pneumatic, hydraulic or otherwise driven drive.

Figure 6:
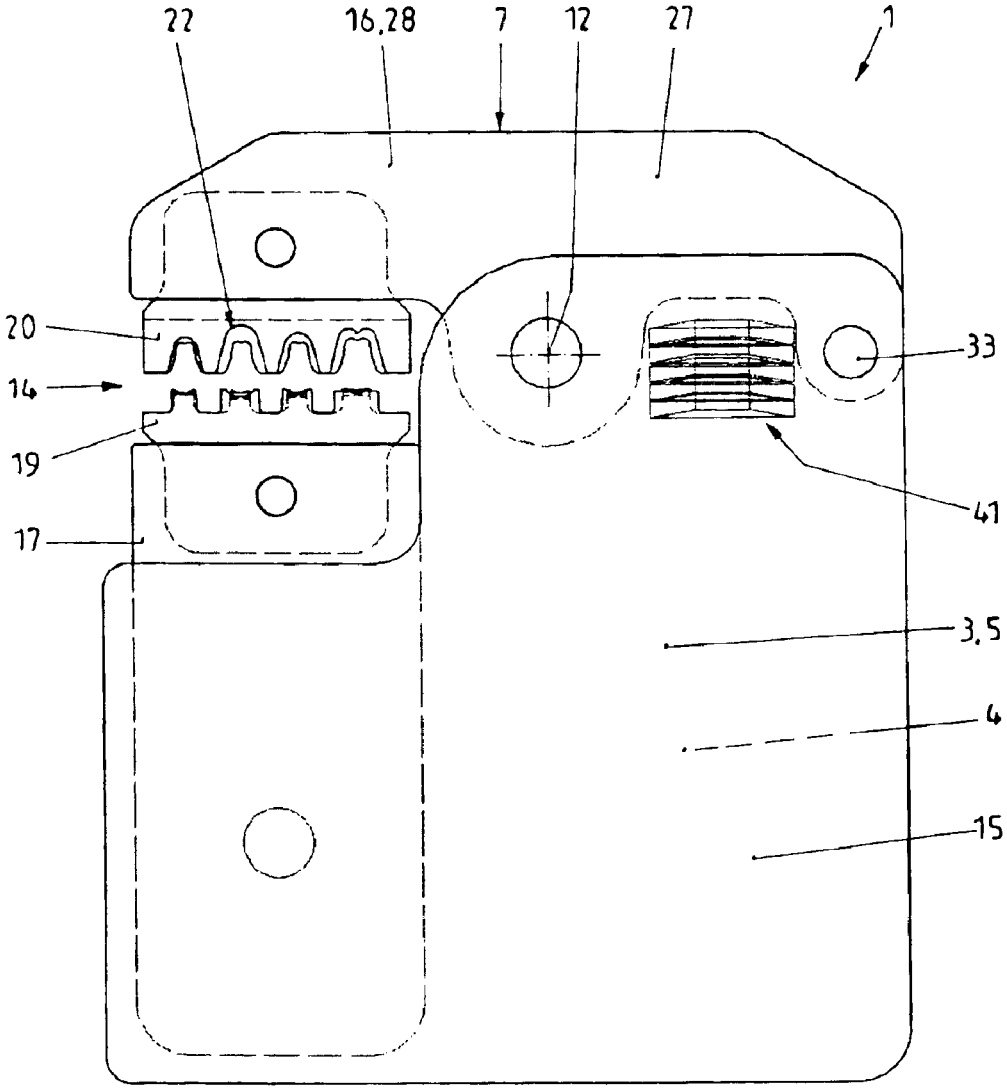
FIG. 6 is a top view of the novel pliers head.

FIG. 6 illustrates another exemplary embodiment of the novel pliers head 1. The lever 7 is not designed as an angled lever, but instead as an elongated element to be pivotal about the axis 12. The lever arm 27 is supported at the stop 33. A spring arrangement 41 serves to supply the pretensional force. The spring arrangement 41 is only schematically illustrated. The spring arrangement 41 includes a plurality of disc springs. Such disc springs are capable of supplying great forces at small spring paths. It is to be understood that the spring arrangement 41 is supported at the stiff housing 2 and that it subjects the lever 7 and the lever arm 27, respectively, with a counter-clockwise torque. In this embodiment, it is preferred to design the lever 7 to be stiff to bending since it is not the lever 7 which is intended to be resilient. Instead, the desired pretensional force for counter-acting undesired movement of the stationary is caused by the spring arrangement 41.

Many variations and modifications may be made to the preferred embodiments of the invention without departing substantially from the spirit and principles of the invention. All such modifications and variations are intended to be included herein within the scope of the present invention, as defined by the following claims.

We claim:

1. A pliers head for pressing work pieces, comprising:

a stationary die;

a movable die;

a first element being designed as a comparatively stiff housing;

a second element being designed as a lever, said lever being designed and arranged to be subjectable to a pretensional force, the pretensional force having at least the value of a predetermined maximum pressing force of said pliers head, said first and second element being designed as separate parts and being designed and arranged to form a C-shaped mouth, said dies being located in said C-shaped mouth;

a joint being located at said first element and being designed and arranged to allow for pivotal movement of said second element with respect to said first element; and a stop being designed and arranged to secure a parallel position of said stationary die and said movable die with respect to one another.

2. The pliers head of claim 1, wherein said lever is at least partly designed as a deformable bending lever, said bending lever including:

a first lever arm, said first lever arm being designed to be comparatively stiff to bending, said first lever arm being connected to said stationary crimping die; and a second lever arm, said second lever arm being designed to be comparatively resilient, said second lever arm not being connected to said dies.

3. The pliers head of claim 2, further comprising an adjustable second stop being designed and arranged to apply pretensional forces onto said second lever arm.

4. The pliers head of claim 1, wherein said joint includes a pin being connected to said stiff housing, and said lever is designed as a rocking lever having a middle portion, said rocking lever with its middle portion being designed and arranged to be pivotable about said pin.

5. The pliers head of claim 2, wherein said joint includes a pin being connected to said stiff housing, and said lever is designed as a rocking lever having a middle portion, said rocking lever with its middle portion being designed and arranged to be pivotable about said pin.

6. The pliers head of claim 3, wherein said joint includes a pin being connected to said stiff housing, and said lever is designed as a rocking lever having a middle portion, said rocking lever with its middle portion being designed and arranged to be pivotable about said pin.

7. The pliers head of claim 1, wherein said lever has an approximately rectangular shape.

8. The pliers head of claim 2, wherein said lever has an approximately rectangular shape.

9. The pliers head of claim 3, wherein said lever has an approximately rectangular shape.

10. The pliers head of claim 4, wherein said lever has an approximately rectangular shape.

11. The pliers head of claim 5, wherein said lever has an approximately rectangular shape.

12. The pliers head of claim 6, wherein said lever has an approximately rectangular shape.

13. The pliers head of claim 1, wherein said stop is designed as a pin, said pin being designed and arranged to protrude through said stiff housing and through said lever.

14. The pliers head of claim 13, further comprising an elongated hole being located in said stiff housing, said pin being designed and arranged to protrude through said elongated hole.

15. The pliers head of claim 13, further comprising an elongated hole being located in said lever, said pin being designed and arranged to protrude through said elongated hole.

16. The pliers head of claim 3, wherein said adjustable second stop is designed as an eccentric bolt, said eccentric bolt being supported at said stiff housing.

17. The pliers head of claim 1, wherein said pliers head has a plane of main extension;

said stiff housing includes two cover plates; and said lever includes two plates, said cover plates and said plates being designed and arranged to be symmetric with respect to the plane of main extension of said pliers head.

18. The pliers head of claim 1, wherein said stationary die is connected to said lever and said movable die is connected to said stiff housing.

19. The pliers head of claim 1, further comprising a spring unit, said spring unit being designed and arranged to supply pretension to said lever, said lever being designed to be stiff to bending.

20. A pliers head for pressing work pieces, comprising:

a stationary die;

a movable die, said stationary die and said movable die being associated with one another to form at least one nest being designed and arranged for receiving a work piece to be pressed;

a housing, said housing being designed to be comparatively stiff, said housing being designed and arranged to support said movable die in a way that said movable die is movable in a linear direction towards and away from said stationary die;

a lever, said lever being connected to said stationary die, said lever and said housing being designed as separate parts and being designed and arranged to form a C-shaped mouth in which said dies are located;

a joint being designed and arranged to connect said housing and said lever in a way that said lever may be pivoted with respect to said housing about said joint;

a stop being designed and arranged to limit pivotal movement of said lever with respect to said housing; and a resilient element, said resilient element being designed and arranged to supply pretensional torque to said lever, the pretensional torque counteracting pressing torque resulting from a movement of said movable die towards said stationary die, said resilient element and said stop being designed and arranged to secure a parallel position of said first and second die with respect to one another.

21. The pliers head of claim 20, further comprising an adjustable second stop, wherein said lever is at least partly designed as a deformable bending lever, said bending lever including:

a first lever arm, said first lever arm being designed to be comparatively stiff to bending, said first lever arm being connected to said stationary crimping die; and a second lever arm, said second lever arm being designed to be comparatively resilient, said second lever arm not being connected to said dies, said adjustable second stop and said second lever arm together forming said resilient element.

22. The pliers head of claim 21, wherein said adjustable second stop is designed as an eccentric bolt, said eccentric bolt being supported at said housing.

23. The pliers head of claim 20, wherein said resilient element is designed as a spring unit including a least one disk spring.

24. The pliers head of claim 20, wherein said joint includes a pin being connected to said housing, and said lever is designed as a rocking lever having a middle portion, said rocking lever with its middle portion being designed and arranged to be pivotable about said pin.

25. The pliers head of claim 21, wherein said joint includes a pin being connected to said housing, and said lever is designed as a rocking lever having a middle portion, said rocking lever with its middle portion being designed and arranged to be pivotable about said pin.

* * * * *